US010866004B2

(12) United States Patent
Shiohama et al.

(10) Patent No.: US 10,866,004 B2
(45) Date of Patent: Dec. 15, 2020

(54) REFRIGERATION APPARATUS WITH SHUTOFF VALVE

(71) Applicant: DAIKIN INDUSTRIES, LTD., Osaka (JP)

(72) Inventors: Kousuke Shiohama, Osaka (JP); Yoshiteru Nouchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/478,036

(22) PCT Filed: Dec. 26, 2017

(86) PCT No.: PCT/JP2017/046660
§ 371 (c)(1),
(2) Date: Jul. 15, 2019

(87) PCT Pub. No.: WO2018/131467
PCT Pub. Date: Jul. 19, 2018

(65) Prior Publication Data

US 2019/0368752 A1 Dec. 5, 2019

(30) Foreign Application Priority Data

Jan. 16, 2017 (JP) ..... 2017-005351

(51) Int. Cl.
*F24F 11/02* (2006.01)
*F24F 11/36* (2018.01)
(Continued)

(52) U.S. Cl.
CPC ..... *F24F 11/36* (2018.01); *F24F 1/32* (2013.01); *F24F 11/84* (2018.01); *F24F 11/89* (2018.01);
(Continued)

(58) Field of Classification Search
CPC ..... F25B 2500/22; F25B 2500/221; F25B 2500/222; F24F 11/36
See application file for complete search history.

(56) References Cited

U.S. PATENT DOCUMENTS

2014/0033754 A1* 2/2014 Hatomura ..... F25B 13/00 62/190
2015/0184644 A1* 7/2015 Lundberg ..... F04B 53/16 417/53

FOREIGN PATENT DOCUMENTS

CN 104567158 A 4/2015
JP 2-52967 A 2/1990
(Continued)

OTHER PUBLICATIONS

Written Opinion of the International Searching Authority, issued in PCT/JP2017/046660, dated Mar. 6, 2018.
(Continued)

*Primary Examiner* — Jonathan Bradford
(74) *Attorney, Agent, or Firm* — Birch, Stewart, Kolasch & Birch, LLP

(57) ABSTRACT

A refrigeration apparatus includes a refrigerant circuit including a utilization unit. The utilization unit includes: a heat exchanger; first and second refrigerant pipes connected to the heat exchanger; and first and second shutoff valves each of whose opening degrees are adjustable and which are respectively provided at the first refrigerant pipe and the second refrigerant pipe. The refrigeration apparatus includes: a refrigerant leakage detector; a refrigerant pressure acquiring part; and a controller configured to adjust the opening degrees of the first shutoff valve and the second shutoff valve. In an alert state where the first shutoff valve and the second shutoff valve are both closed and the refrigerant leakage detector detects the leakage, the controller adjusts the opening degree of at least one of the first and
(Continued)

second shutoff valves to open when the pressure of the refrigerant is greater than a predetermined threshold value.

10 Claims, 6 Drawing Sheets

(51) Int. Cl.

| | |
|---|---|
| ***F24F 1/32*** | (2011.01) |
| *F24F 11/84* | (2018.01) |
| *F24F 11/89* | (2018.01) |
| *F25B 1/00* | (2006.01) |
| *F25B 49/02* | (2006.01) |

(52) U.S. Cl.
CPC ..... *F25B 1/00* (2013.01); *F25B 49/02* (2013.01); *F25B 2500/07* (2013.01); *F25B 2500/222* (2013.01)

(56) References Cited

FOREIGN PATENT DOCUMENTS

| | | | |
|---|---|---|---|
| JP | 2008-170058 | A | 7/2008 |
| JP | 2012-13339 | A | 1/2012 |
| JP | 5517789 | B2 | 6/2014 |

OTHER PUBLICATIONS

International Search Report, issued in PCT/JP2017/046660, dated Mar. 6, 2018.
Extended European Search Report dated Feb. 4, 2020 in corresponding European Application No. 17891739.9.

* cited by examiner

REFRIGERATION APPARATUS WITH SHUTOFF VALVE

TECHNICAL FIELD

The present invention relates to a refrigeration apparatus with a shutoff valve.

BACKGROUND ART

A refrigerant circulates through a refrigerant circuit which is a component of a refrigeration apparatus such as an air conditioner, a refrigerator, or a hot water supplier. Some substances used as the refrigerant are toxic to humans or cause suffocation. In order to minimize any detrimental effect on the user's health by the refrigerant leaked out from the refrigerant circuit, what may be installed is a circuit shutoff mechanism configured to shut off part of the refrigerant circuit including the portion where the leakage has occurred. For example, Patent Literature 1 (Japanese Patent No. 5517789) discloses an air conditioner including a circuit shutoff mechanism which includes an expansion valve and an electromagnetic valve.

SUMMARY OF THE INVENTION

Technical Problem

In a pipe shut off by the circuit shutoff mechanism, a certain amount of refrigerant is enclosed. If a refrigerant leakage is erroneously detected and the refrigerant circuit is heated by any external factor, the expanded refrigerant may rupture the pipe. Such a breakage of the refrigeration apparatus directly injures the user. Additionally, the breakage inconveniently forces the user to ask a technician for recovery.

An object of the present invention is to provide a refrigeration apparatus with a reduced risk of breakage, thereby providing the user with safety and convenience.

Solution to Problem

A refrigeration apparatus according to a first aspect of the present invention includes a refrigerant circuit including a utilization unit. The refrigeration apparatus allows a refrigerant to circulate through the refrigerant circuit to carry out a refrigeration cycle. The utilization unit includes: a heat exchanger; a first refrigerant pipe and a second refrigerant pipe connected to the heat exchanger; a first shutoff valve and a second shutoff valve whose opening degrees are adjustable, the first shutoff valve and the second shutoff valve being respectively provided at the first refrigerant pipe and the second refrigerant pipe. The refrigeration apparatus further includes: a refrigerant leakage detector configured to detect a leakage of the refrigerant from the refrigerant circuit: a refrigerant pressure acquiring part configured to acquire a pressure of the refrigerant; a controller configured to adjust the opening degrees of the first shutoff valve and the second shutoff valve. In an alert state where the first shutoff valve and the second shutoff valve are both closed and the refrigerant leakage detector detects the leakage, the controller adjusts the opening degree of at least one of the first shutoff valve and the second shutoff valve to open when the pressure of the refrigerant is greater than a predetermined threshold value.

In this configuration, the refrigerant enclosed by the first shutoff valve and the second shutoff valve is released, when its pressure has increased, through the shutoff valve whose opening degree is adjusted to open. This restrains the risk of breakage of the refrigeration apparatus due to the enclosed refrigerant with increased pressure.

A refrigeration apparatus according to a second aspect of the present invention is the refrigeration apparatus according to the first aspect, in which, in the alert state, the controller increases the opening degree of at least one of the first shutoff valve and the second shutoff valve as the pressure of the refrigerant is greater.

In this configuration, the opening degree of the shutoff valve is set to be greater as the pressure of the refrigerant is greater. Accordingly, the failed portion is shut off while taking into consideration the urgency of releasing the enclosed refrigerant.

A refrigeration apparatus according to a third aspect of the present invention is the refrigeration apparatus according to the first or second aspect, in which the utilization unit further includes a casing housing the heat exchanger. At least one of the first shutoff valve and the second shutoff valve is provided outside the casing.

In this configuration, at least one of the first shutoff valve and the second shutoff valve is provided outside the casing. Thus, the utilization unit can be downsized.

A refrigeration apparatus according to a fourth aspect of the present invention is the refrigeration apparatus according to the third aspect, further including a valve unit. At least one of the first shutoff valve and the second shutoff valve is provided at the valve unit.

In this configuration, at least one of the first shutoff valve and the second shutoff valve is provided at the valve unit. Accordingly, by the valve unit being disposed in any usually vacant space such as an attic, the space is efficiently used.

A refrigeration apparatus according to a fifth aspect of the present invention is the refrigeration apparatus according to any one of the first to fourth aspects, in which the refrigerant pressure acquiring part includes a temperature acquiring part and a converting part. The temperature acquiring part is configured to acquire any of a temperature of the refrigerant, a temperature of a room where the utilization unit is installed, and a temperature in the utilization unit. The converting part is configured to convert the temperature into the pressure.

In this configuration, the refrigerant pressure acquiring part is formed of the temperature acquiring part and the converting part. Accordingly, the heat exchanger or the pipe do not require any dedicated pressure sensor.

A method according to a sixth aspect of the present invention is a method of reducing a pressure of the refrigerant in a refrigerant circuit including a utilization unit and allowing the refrigerant to circulate through the refrigerant circuit to carry out a refrigeration cycle. The utilization unit includes: a heat exchanger; a first refrigerant pipe and a second refrigerant pipe connected to the heat exchanger; and a first shutoff valve and a second shutoff valve whose opening degrees are adjustable, the first shutoff valve and the second shutoff valve being respectively provided at the first refrigerant pipe and the second refrigerant pipe. The method includes: detecting, by a refrigerant leakage detector, a leakage of the refrigerant; closing, by a controller, the first shutoff valve and the second shutoff valve in response to the detecting the leakage; acquiring, by a refrigerant pressure acquiring part, a pressure of the refrigerant; and in an alert state where the first shutoff valve and the second shutoff valve are both closed and the refrigerant leakage detector detects the leakage, adjusting, by the controller, the opening degree of at least one of the first shutoff valve and the second shutoff valve to open when the pressure of the refrigerant is greater than a predetermined threshold value.

In this method, the refrigerant enclosed by the first shutoff valve and the second shutoff valve is released, when its pressure has increased, through the shutoff valve whose opening degree is adjusted to open. This restrains the risk of breakage of the refrigerant circuit due to the enclosed refrigerant with increased pressure.

Advantageous Effects of Invention

The refrigeration apparatus according to the first aspect of the present invention restrains the risk of breakage of the refrigeration apparatus due to the enclosed refrigerant with increased pressure.

The refrigeration apparatus according to the second aspect of the present invention shuts off the failed portion while taking into consideration of the urgency of releasing the enclosed refrigerant.

The refrigeration apparatus according to the third aspect of the present invention downsizes the utilization unit.

The refrigeration apparatus according to the fourth aspect of the present invention achieves efficient use of the space.

The refrigeration apparatus according to the fifth aspect of the present invention eliminates the necessity of providing a dedicated pressure sensor.

The method according to the sixth aspect of the present invention restrains the risk of breakage of the refrigerant circuit due to the enclosed refrigerant with increased pressure.

DESCRIPTION OF EMBODIMENTS

First Embodiment (1) General Configuration

Figure 1:
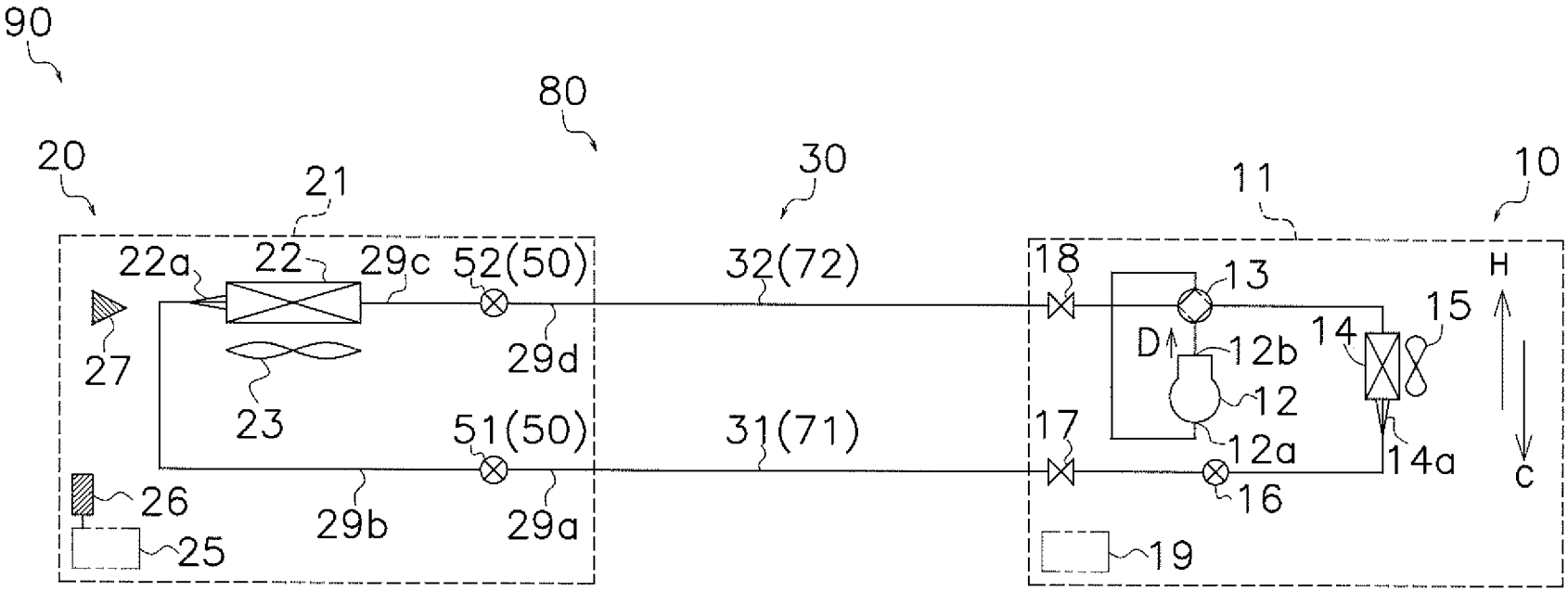
FIG. 1 is a schematic diagram of a refrigeration apparatus 90 according to a first embodiment of the present invention.

FIG. 1 shows a refrigeration apparatus 90 according to a first embodiment of the present invention. The refrigeration apparatus 90 is configured as an air conditioning apparatus. Alternatively, the refrigeration apparatus 90 may be implemented as other apparatus such as a refrigerator or a hot water supplier. The refrigeration apparatus 90 includes a refrigerant circuit 80 which carries out a refrigeration cycle through circulation of a refrigerant. The refrigerant circuit 80 includes a heat source unit 10, a utilization unit 20, and a connection pipe 30.

(2) Configuration Details (2-1) Heat Source Unit 10

The heat source unit 10 functions as a cold source or a hot source, and is representatively installed outdoors. The heat source unit 10 includes a casing 11, a compressor 12, a four-way switching valve 13, a heat-source-side heat exchanger 14, a fan 15, a heat-source-side expansion valve 16, a liquid-side stop valve 17, a gas-side stop valve 18, a controller 19, and pipes connecting between these elements.

(2-1-1) Casing 11

The casing 11 houses the components of the heat source unit 10.

(2-1-2) Compressor 12

The compressor 12 compresses a low-pressure gas refrigerant to discharge a high-pressure gas refrigerant. The compressor 12 includes a suction inlet 12*a* and a discharge outlet 12*b*. The low-pressure gas refrigerant is taken in from the suction inlet 12*a*. The high-pressure gas refrigerant is discharged from the discharge outlet 12*b* in the direction indicated by arrow D.

(2-1-3) Four-Way Switching Valve 13

The four-way switching valve 13 switches the operation between the cooling operation and the heating operation. In carrying out the cooling operation, the four-way switching valve 13 establishes connection represented by the solid line in FIG. 1, whereby the refrigerant circulates in the direction indicated by arrow C. On the other hand, in carrying out the heating operation, the four-way switching valve 13 establishes connection represented by the broken line in FIG. 1, whereby the refrigerant circulates in the direction indicated by arrow H.

(2-1-4) Heat-Source-Side Heat Exchanger 14

The heat-source-side heat exchanger 14 allows the refrigerant and the outside air to exchange heat. The heat-source-side heat exchanger 14 functions as a heat radiator in the cooling operation, and functions as a heat absorber in the heating operation. The heat-source-side heat exchanger 14 may include a refrigerant distributor 14*a*. The refrigerant distributor 14*a* is effective in, for example in the heating operation, evenly sending a low-pressure gas-liquid two-phase refrigerant to the elements of the heat-source-side heat exchanger 14.

(2-1-5) Fan 15

The fan 15 facilitates the heat exchange between the refrigerant and the outside air with the heat-source-side heat exchanger 14.

(2-1-6) Heat-Source-Side Expansion valve 16

The heat-source-side expansion valve 16 is a valve whose opening degree is adjustable. The opening degree is electrically adjusted, for example. As necessary, the heat-source-side expansion valve 16 decompresses the refrigerant or adjusts the amount of the refrigerant passing through the heat-source-side expansion valve 16.

(2-1-7) Liquid-Side Stop Valve 17, Gas-Side Stop Valve 18

The liquid-side stop valve 17 and the gas-side stop valve 18 are configured to open or close the passage of the refrigerant. The opening and the closing are performed manually, for example. The liquid-side stop valve 17 and the gas-side stop valve 18 are closed for example when the refrigeration apparatus 90 is installed, in order to prevent leakage of the refrigerant enclosed in the heat source unit 10 to the outside. On the other hand, the liquid-side stop valve 17 and the gas-side stop valve 18 are opened when the refrigeration apparatus 90 is in operation.

(2-1-8) Control Unit 19

The controller 19 receives output signals from various sensors installed in the heat source unit 10. The various sensors may include a temperature sensor or a pressure sensor which is not shown. The controller 19 drives the compressor 12, the four-way switching valve 13, the fan 15, the heat-source-side expansion valve 16, and other actuators which are not shown.

(2-2) Connection Pipe 30

The connection pipe 30 guides the refrigerant between the heat source unit 10 and the utilization unit 20. The connection pipe 30 includes a liquid connection pipe 31 and a gas connection pipe 32. The liquid connection pipe 31 is connected to the liquid-side stop valve 17. The gas connection pipe 32 is connected to the gas-side stop valve 18. The liquid connection pipe 31 mainly guides a liquid refrigerant or a gas-liquid two-phase refrigerant.

The gas connection pipe 32 mainly guides a gas refrigerant.

(2-3) Service Unit 20

The utilization unit 20 is configured to provide the user with cold or heat, and representatively provided indoors. The utilization unit 20 forming an air conditioner adjusts the temperature in the user's room by blowing cool air or warm air into the room. The utilization unit 20 includes a casing 21, a utilization-side heat exchanger 22, a fan 23, a circuit shutoff mechanism 50, a refrigerant releasing part 53, and pipes 29*a* to 29*d* connecting between these elements. The utilization unit 20 further includes a controller 25, a refrigerant leakage detector 26, and a refrigerant pressure acquiring part 27.

(2-3-1) Casing 21

The casing 21 houses the components of the utilization unit 20.

(2-3-2) Service-Side Heat Exchanger 22

The utilization-side heat exchanger 22 allows the refrigerant and the room air to exchange heat. The utilization-side heat exchanger 22 functions as a heat absorber in the cooling operation, and functions as a heat radiator in the heating operation. The utilization-side heat exchanger 22 may include a refrigerant distributor 22*a*. The refrigerant distributor 22*a* is effective in, for example in the cooling operation, evenly sending a low-pressure gas-liquid two-phase refrigerant to the elements of the utilization-side heat exchanger 22.

(2-3-3) Fan 23

The fan 23 facilitates the heat exchange between the refrigerant and the room air with the utilization-side heat exchanger 22. The fan 23 blows the air having exchanged heat from the casing 21 into the room space.

(2-3-4) Refrigerant Leakage Detector 26

The refrigerant leakage detector 26 detects a leakage of the refrigerant from the refrigerant circuit 80. The refrigerant leakage detector 26 is formed of, for example, a refrigerant concentration sensor. The refrigerant leakage detector 26 may further include a signal processing circuit for executing a predetermined process on output signals from the refrigerant concentration sensor, for example.

(2-3-5) Refrigerant Pressure Acquiring Part 27

Figure 2:
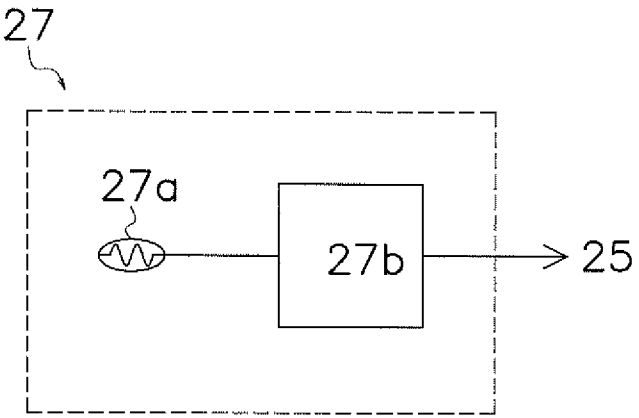
FIG. 2 is a block diagram of a refrigerant pressure acquiring part 27 in the refrigeration apparatus 90 according to the first embodiment of the present invention.

The refrigerant pressure acquiring part 27 acquires the pressure of the refrigerant at a specific location. As shown in FIG. 2, the refrigerant pressure acquiring part 27 includes a temperature acquiring part 27*a* and a converting part 27*b*. The temperature acquiring part 27*a* acquires any target temperature such as the temperature of the refrigerant, the temperature in the room where the utilization unit 20 is installed, or the temperature in the utilization unit 20. The converting part 27*b* converts the temperature acquired by the temperature acquiring part 27*a* into the pressure of the refrigerant.

(2-3-6) Circuit Shutoff Mechanism 50

With reference to FIG. 1 again, the circuit shutoff mechanism 50 is configured to shut off the refrigerant circuit 80 when a leakage of the refrigerant is detected. The circuit shutoff mechanism 50 includes a first shutoff valve 51 and a second shutoff valve 52. The first shutoff valve 51 and the second shutoff valve 52 are valves whose opening degrees are adjustable. The first shutoff valve 51 and the second shutoff valve 52 are controlled to be closed upon detection of the refrigerant leakage. The first shutoff valve 51 connected on the liquid connection pipe 31 side may be used in decompressing the refrigerant.

(2-3-7) Pipes 29*a* to 29*d*

The pipe 29*a* connects between the liquid connection pipe 31 and the first shutoff valve 51. The pipe 29*a* may be a member separate from the liquid connection pipe 31 and connected to the liquid connection pipe 31. Alternatively, the pipe 29*a* may be integrated with the liquid connection pipe 31.

The pipe 29*b* connects between the first shutoff valve 51 and the utilization-side heat exchanger 22. In the case where the utilization-side heat exchanger 22 includes the refrigerant distributor 22*a*, the pipe 29*b* is connected to the refrigerant distributor 22*a*.

The pipe 29*c* connects between the utilization-side heat exchanger 22 and the second shutoff valve 52.

The pipe 29*d* connects between the gas connection pipe 32 and the second shutoff valve 52. The pipe 29*d* may be a member separate from the gas connection pipe 32 and connected to the gas connection pipe 32. Alternatively, the pipe 29*d* may be integrated with the gas connection pipe 32.

In the present specification, the pipe connecting between the liquid-side stop valve 17 and the utilization-side heat exchanger 22 is referred to as "the first refrigerant pipe 71". The pipe connecting between the gas-side stop valve 18 and the utilization-side heat exchanger 22 is referred to as "the second refrigerant pipe 72". The first refrigerant pipe 71 includes the liquid connection pipe 31, the pipe 29*a*, and the pipe 29*b*. The second refrigerant pipe 72 includes the gas connection pipe 32, the pipe 29*d*, and the pipe 29*c*. The first shutoff valve 51 is provided at the first refrigerant pipe 71. The second shutoff valve 52 is provided at the second refrigerant pipe 72.

(2-3-8) Controller 25

The controller 25 receives output signals from various sensors provided at the utilization unit 20. The various sensors include the refrigerant leakage detector 26 and the refrigerant pressure acquiring part 27, and may further include a temperature sensor or a pressure sensor which is not shown. The controller 25 further drives the fan 23, the first shutoff valve 51, the second shutoff valve 52, and other actuators which are not shown. The controller 25 further communicates with the controller 19 of the heat source unit 10 via a communication line which is not shown.

(3) Basic Operation of Refrigeration Cycle

In the following, for the sake of convenience, a description will be given of the basic operation of the refrigeration cycle of the refrigeration apparatus 90 based on the premise that the refrigerant reacts with a phase change such as concentration or evaporation. Here, so long as a reaction causes heat dissipation or heat absorption, a phase change is not essential.

(3-1) Cooling Operation

With reference to FIG. 1, the four-way switching valve 13 of the heat source unit 10 establishes connection represented by the solid line. The compressor 12 discharges a high-pressure gas refrigerant in the direction indicated by arrow D. Thereafter, the high-pressure gas refrigerant passes through the four-way switching valve 13 and reaches the heat-source-side heat exchanger 14, to be condensed and become a high-pressure liquid refrigerant. The high-pressure liquid refrigerant reaches the heat-source-side expansion valve 16, to be decompressed and become a low-pressure gas-liquid two-phase refrigerant. The low-pressure gas-liquid two-phase refrigerant passes through the open liquid-side stop valve 17 and the liquid connection pipe 31 in sequence, and enters the utilization unit 20. The low-pressure gas-liquid two-phase refrigerant is decompressed by the first shutoff valve 51 as necessary. The low-pressure gas-liquid two-phase refrigerant reaches the utilization-side heat exchanger 22, to be evaporated and become a low-pressure gas refrigerant. Here, in the course of becoming the low-pressure gas refrigerant, the refrigerant absorbs heat and provides the user with cold. The low-pressure gas refrigerant passes through the second shutoff valve 52 which is fully open, the gas connection pipe 32, and the gas-side stop valve 18 which is open in sequence, and enters the heat source unit 10. After passing through the four-way switching valve 13, the low-pressure gas refrigerant is taken into the compressor 12.

(3-2) Heating Operation

With reference to FIG. 1, the four-way switching valve 13 of the heat source unit 10 establishes connection represented by the broken line. The compressor 12 discharges a high-pressure gas refrigerant in the direction indicated by arrow D. The high-pressure gas refrigerant passes through the four-way switching valve 13, and thereafter passes through the open gas-side stop valve 18 and the gas connection pipe 32 in sequence and enters the utilization unit 20. The high-pressure gas refrigerant passes through the second shutoff valve 52 which is fully open and reaches the utilization-side heat exchanger 22, to be condensed and become a high-pressure liquid refrigerant. In the course of becoming the high-pressure liquid refrigerant, the refrigerant provides the user with heat. The high-pressure liquid refrigerant passes through the first shutoff valve 51, the liquid connection pipe 31, and the liquid-side stop valve 17 which is open in sequence, and enters the heat source unit 10 to reach the heat-source-side expansion valve 16. The high-pressure liquid refrigerant is decompressed by the heat-source-side expansion valve 16, or the first shutoff valve 51, or both of the heat-source-side expansion valve 16 and the first shutoff valve 51, to become a low-pressure gas-liquid two-phase refrigerant. The low-pressure gas-liquid two-phase refrigerant reaches the heat-source-side heat exchanger 14, to absorb heat and be evaporated thereby becoming a low-pressure gas refrigerant. The low-pressure gas refrigerant is taken into the compressor 12 through the four-way switching valve 13.

(4) Operation in Response to Failure

Figure 3:
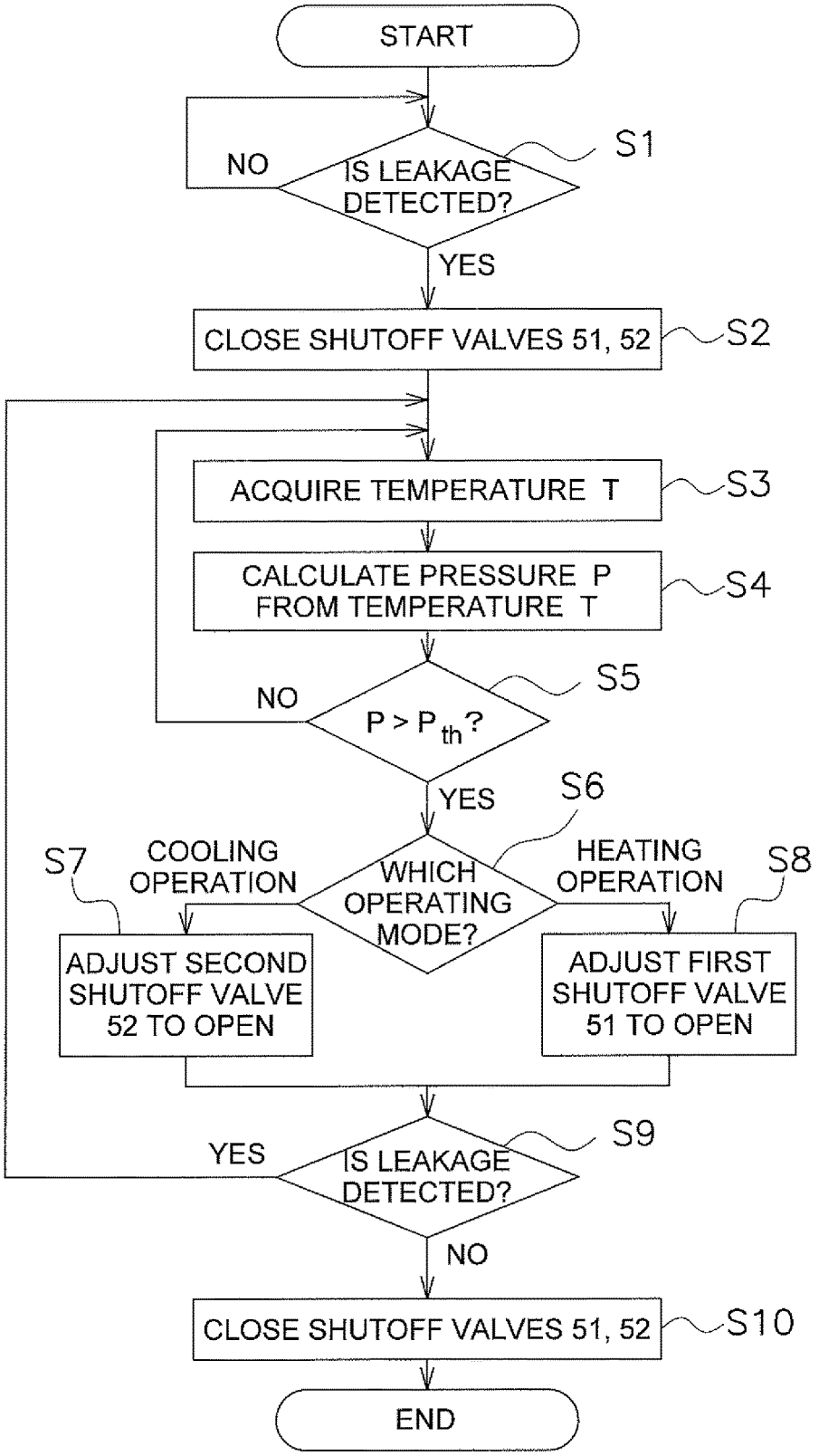
FIG. 3 is a flowchart of control in the refrigeration apparatus 90.

FIG. 3 is a flowchart of control in response to a failure. In step S1, the refrigerant leakage detector 26 checks whether a refrigerant leakage is detected. When the refrigerant leakage detector 26 detects no refrigerant leakage (S1: NO), step S1 is again performed. When the refrigerant leakage detector 26 detects a refrigerant leakage (S1: YES), control proceeds to step S2.

In step S2, the controller 25 closes the first shutoff valve 51 and the second shutoff valve 52. Thus, in the refrigerant circuit 80, the utilization unit 20 is shut off, and supply of the refrigerant to the utilization unit 20 is stopped. This causes "the alert state" where the first shutoff valve 51 and the second shutoff valve 52 are both closed and the refrigerant leakage detector 26 detects a refrigerant leakage. When a pressure error of the refrigerant is detected in the alert state, the refrigerant must be released.

In steps S3 to S5, whether there exists a pressure error is checked.

First, in steps S3 and S4, a pressure P of the refrigerant is acquired. That is, in step S3, the temperature acquiring part 27*a* acquires a temperature T of the target. Next, in step S4, the converting part 27*b* converts the value of the acquired temperature T into a value of the pressure P of the refrigerant.

In step S5, whether there exists a pressure error is determined. The controller 25 compares the pressure P acquired by the refrigerant pressure acquiring part 27 against a predetermined threshold value Pth. When the pressure P is equal to or lower than the threshold value Pth (S5: NO), it is determined that no pressure error exists, and control returns to step S3. When the pressure P exceeds the threshold value Pth (S5: YES), it is determined that there exists a pressure error, and control proceeds to step S6.

In steps S6 to S8, the refrigerant is released.

In step S6, the operating mode is checked. When the operating mode is the cooling operation (S6: cooling operation), control proceeds to step S7. When the operating mode is the heating operation (S6: heating operation), control proceeds to step S8.

In step S7, the refrigerant is released in the cooling operation. The controller 25 adjusts the second shutoff valve 52 to open. Thus, the enclosed refrigerant is released to the outside through the second refrigerant pipe 72. In the cooling operation, the second refrigerant pipe 72 is used for transferring the refrigerant from the utilization unit 20 toward the heat source unit 10 and, accordingly, the second refrigerant pipe 72 is suitable as the passage for releasing the refrigerant to the outside. Representatively, the second shutoff valve 52 has its opening degree set to a not-fully-open opening degree, for example, a small opening degree. This is for gradually releasing the refrigerant whose pressure is abnormally high. Alternatively, the second shutoff valve 52 may have its opening degree determined in accordance with the value of the acquired pressure P. In this case, for example, as the pressure P of the refrigerant is greater, the controller 25 sets a greater opening degree on the second shutoff valve 52. Control then proceeds to step S9.

In step S8, the refrigerant is released in the heating operation. The controller 25 adjusts the first shutoff valve 51 to open. Thus, the enclosed refrigerant is released to the outside through the first refrigerant pipe 71. In the heating operation, the first refrigerant pipe 71 is used for transferring the refrigerant from the utilization unit 20 toward the heat source unit 10 and, accordingly, the first refrigerant pipe 71 is suitable as the passage for releasing the refrigerant to the outside. Representatively, the first shutoff valve 51 has its opening degree set to a not-fully-open opening degree, for example, a small opening degree. This is for gradually releasing the refrigerant whose pressure is abnormally high. Alternatively, the first shutoff valve 51 may have its opening degree determined in accordance with the value of the acquired pressure P. In this case, for example, as the pressure P of the refrigerant is greater, the controller 25 sets a greater opening degree on the first shutoff valve 51. Control then proceeds to step S9.

Steps S9 and S10 are the ending process. In step S9, whether a refrigerant leakage is still detected by the refrigerant leakage detector 26 is checked. When a refrigerant leakage is still detected (S9: YES), control returns to step 3. When no refrigerant leakage is detected (S9: NO), control proceeds to step S10.

In step S10, both of the first shutoff valve 51 and the second shutoff valve 52 are again closed. Thus, the utilization unit 20 with the leakage of the refrigerant is shut off in the refrigerant circuit 80, and supply of the refrigerant to the utilization unit 20 is stopped.

(5) Characteristic (5-1)

When the pressure of the refrigerant enclosed by the first shutoff valve 51 and the second shutoff valve 52 has increased, the refrigerant is released through the shutoff valve, that is, the first shutoff valve 51 or the second shutoff valve 52, which has its opening degree adjusted to open. This restrains the risk of breakage of the refrigeration apparatus 90 due to the enclosed refrigerant with increased pressure.

(5-2)

In the alert state, control may be exerted so as to increase the opening degree of the first shutoff valve 51 or the second shutoff valve 52 as the pressure of the refrigerant is greater. In this case, the failed portion can be shut off while taking into consideration the urgency of releasing the enclosed refrigerant.

(5-3)

The refrigerant pressure acquiring part 27 is formed of the temperature acquiring part 27*a* and the converting part 27*b*. Accordingly, the utilization-side heat exchanger 22 or the pipes 29*a* to 29*d* do not require any dedicated pressure sensor.

(6) Variation

The following are variations of the present embodiment. Note that, a plurality of variations may be combined as appropriate.

(6-1) Variation 1A: Shutoff Valve Opened for Releasing Refrigerant

In the first embodiment, when the refrigerant must be released, in the cooling operation, the second shutoff valve 52 is adjusted to open (step S7); in the heating operation, the first shutoff valve 51 is adjusted to open (step S8). Alternatively, irrespective of the mode of the operation, i.e., the cooling operation and the heating operation, both of the first shutoff valve 51 and the second shutoff valve 52 may be adjusted to open. This control provides quicker release of the refrigerant.

Alternatively, in the cooling operation, the first shutoff valve 51 may be adjusted to open; in the heating operation, the second shutoff valve 52 may be adjusted to open. This control releases the refrigerant against any restriction on control due to the state of various actuators of the refrigeration apparatus.

(6-2) Variation 1B: Configuration of Refrigerant Leakage Detector 26

In the first embodiment, as shown in FIG. 2, the refrigerant leakage detector 26 includes the temperature acquiring part 27*a*. Alternatively, the refrigerant leakage detector 26 may include a pressure sensor. In this case, the pressure of the refrigerant enclosed by the first shutoff valve 51 and the second shutoff valve 52 is directly acquired by the pressure sensor and sent to the controller 25.

In this configuration, the pressure of the refrigerant is directly acquired by the pressure sensor. Accordingly, by virtue of the improved precision of the acquired pressure value, the timing of releasing the refrigerant is accurately determined.

(6-3) Variation 1C: Location of First Shutoff Valve 51 and Second Shutoff Valve 52 (1)

In the first embodiment, the first shutoff valve 51 and the second shutoff valve 52 are provided in the casing 21 of the utilization unit 20. Alternatively, the first shutoff valve 51 and the second shutoff valve 52 may be provided outside the casing 21.

Figure 4:
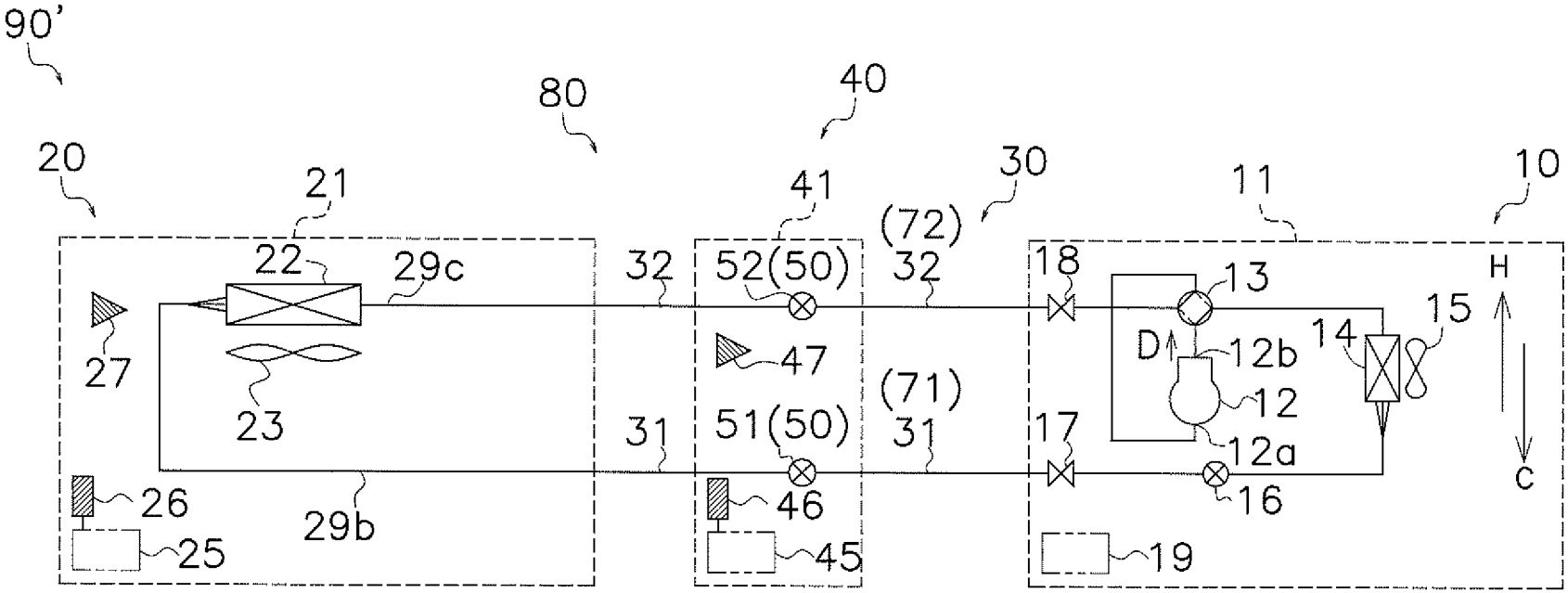
FIG. 4 is a schematic diagram of a refrigeration apparatus 90' according to a variation 1C of the first embodiment of the present invention.

For example, in the configuration shown in FIG. 4, the refrigerant circuit 80 further includes a valve unit 40. The valve unit 40 is provided at the connection pipe 30 connecting between the heat source unit 10 and the utilization unit 20. The valve unit 40 includes a casing 41, a controller 45, a refrigerant leakage detector 46, and a refrigerant pressure acquiring part 47. The casing 41 houses the first shutoff valve 51 and the second shutoff valve 52.

The controller 45 receives output signals from various sensors provided at the valve unit 40. The various sensors include the refrigerant leakage detector 46 and the refrigerant pressure acquiring part 47, and may include other temperature sensor or pressure sensor which is not shown. The controller 45 drives the first shutoff valve 51, the second shutoff valve 52, and other actuators which are not shown. The controller 45 communicates with the controller 19 of the heat source unit 10 and the controller 25 of the utilization unit 20 via a communication line which is not shown.

The first shutoff valve 51 is provided at the liquid connection pipe 31 belonging to the first refrigerant pipe 71. The second shutoff valve 52 is provided at the gas connection pipe 32 belonging to the second refrigerant pipe 72. The passage of the refrigerant in the casing 41 may be configured as an internal pipe which is a member separate from the connection pipe 30 and connected to the connection pipe 30. Alternatively, the passage may be integrated with the connection pipe 30.

The passage of the refrigerant in the utilization unit 20 is similarly configured. The pipe 29*b* connecting between the liquid connection pipe 31 and the utilization-side heat exchanger 22 may be a member separate from the liquid connection pipe 31 and connected to the liquid connection pipe 31. Alternatively, the pipe 29*b* may be integrated with the liquid connection pipe 31. The pipe 29*c* connecting between the gas connection pipe 32 and the utilization-side heat exchanger 22 may be a member separate from the gas connection pipe 32 and connected to the gas connection pipe 32. Alternatively, the pipe 29*c* may be integrated with the gas connection pipe 32.

When one of the refrigerant leakage detector 26 of the utilization unit 20 and the refrigerant leakage detector 46 of the valve unit 40 detects a refrigerant leakage, the first shutoff valve 51 and the second shutoff valve 52 perform the operations similar to those in the first embodiment.

In this configuration, the first shutoff valve 51 and the second shutoff valve 52 are provided outside the casing 21. Accordingly, the utilization unit 20 is downsized.

(6-4) Variation 1D: Location of first shutoff valve 51 and second shutoff valve 52 (2)

In the variation 1C of the first embodiment, the first shutoff valve 51 and the second shutoff valve 52 are both provided outside the casing 21. Alternatively, one of the first shutoff valve 51 and the second shutoff valve 52 may be provided outside the casing 21.

Figure 5:
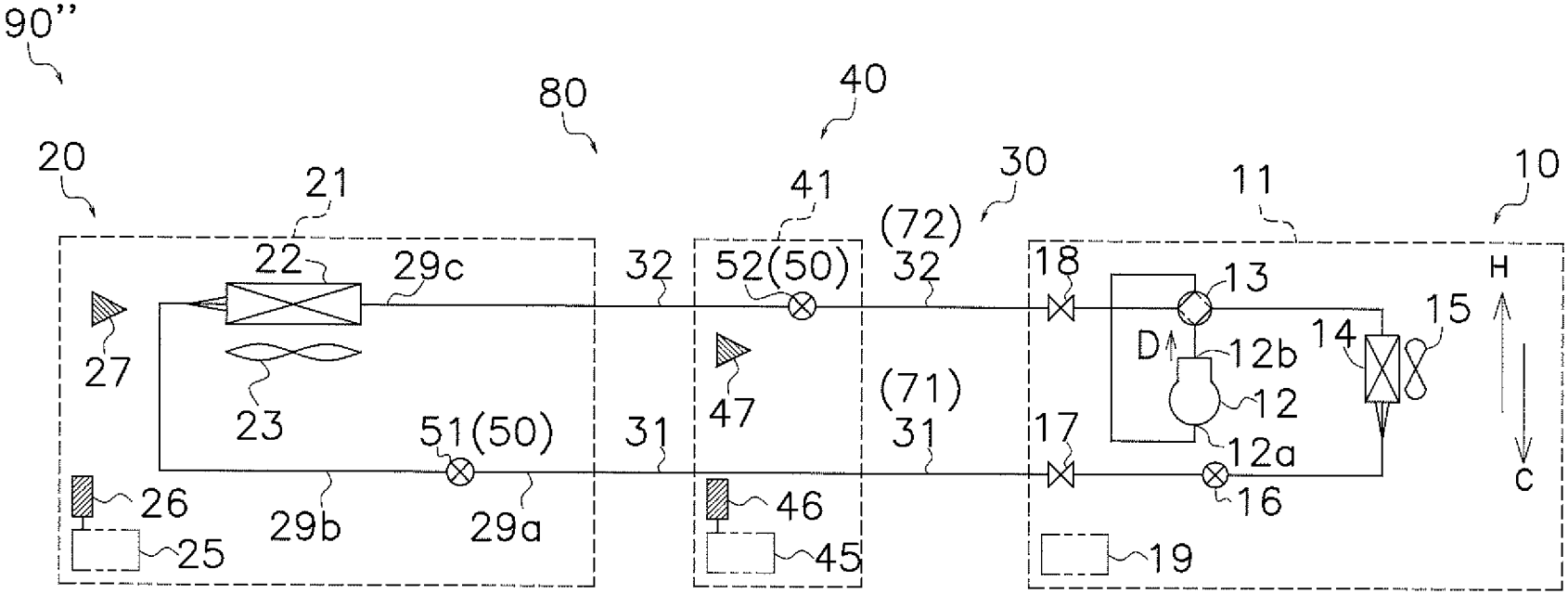
FIG. 5 is a schematic diagram of a refrigeration apparatus 90" according to a variation 1D of the first embodiment of the present invention.

In the configuration shown in FIG. 5, the casing 41 of the valve unit 40 houses the second shutoff valve 52. The first shutoff valve 51 is housed in the casing 21 of the utilization unit 20. The first shutoff valve 51 is mounted on the first refrigerant pipe 71. The first shutoff valve 51 not only shuts off the refrigerant circuit 80 upon detection of a refrigerant leakage, but also serves to decompress the refrigerant.

When one of the refrigerant leakage detector 26 of the utilization unit 20 and the refrigerant leakage detector 46 of the valve unit 40 detects a refrigerant leakage, the first shutoff valve 51 and the second shutoff valve 52 perform the operations similar to those in the first embodiment.

In this configuration, the second shutoff valve 52 is provided outside the casing 21. Accordingly, the utilization unit 20 is downsized.

Second Embodiment (1) Configuration

Figure 6:
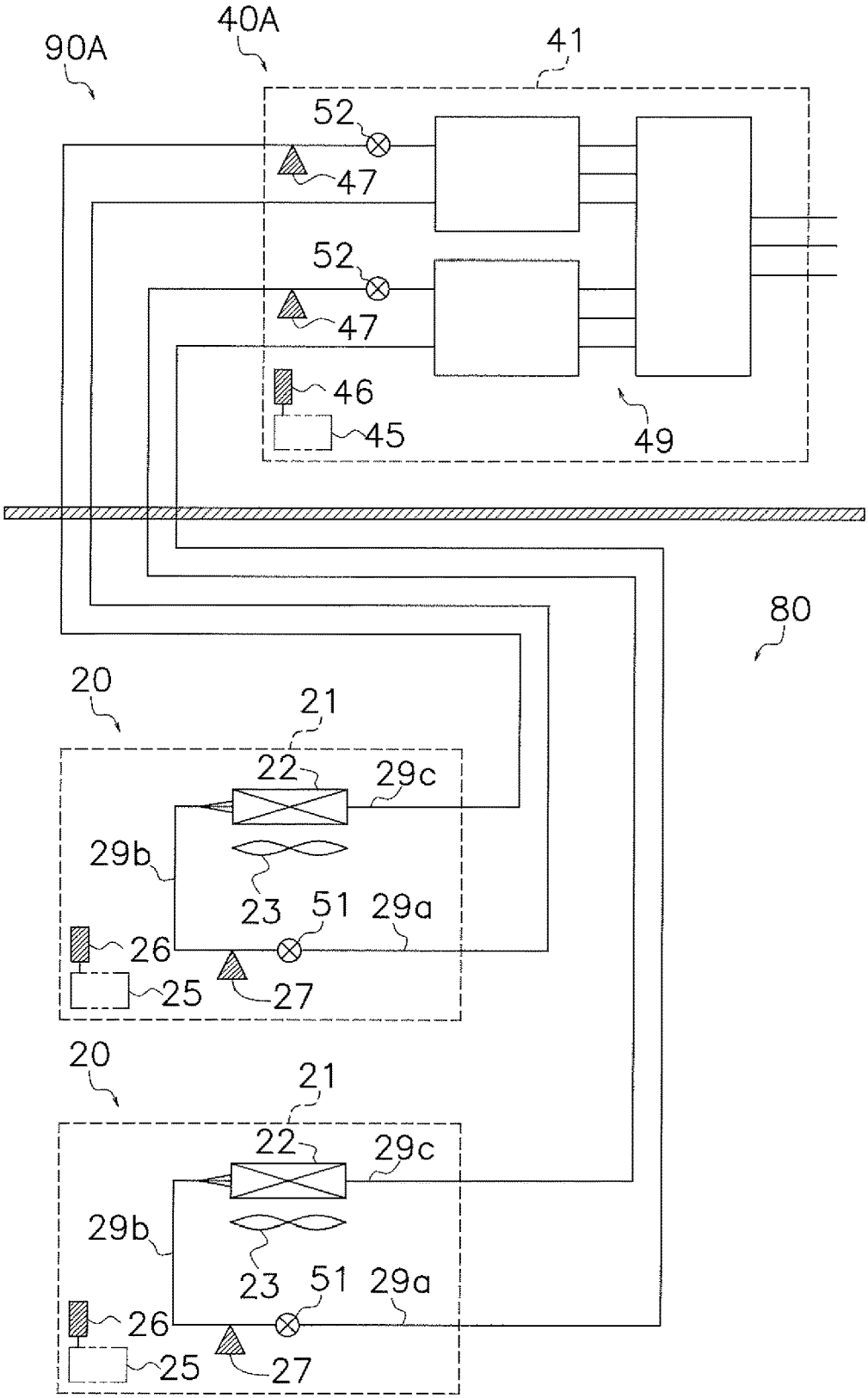
FIG. 6 is a schematic diagram of a refrigeration apparatus 90A of a second embodiment of the present invention.

FIG. 6 shows a refrigeration apparatus 90A according to a second embodiment of the present invention. The refrigeration apparatus 90A is different from the variation 1D according to the first embodiment in including a plurality of utilization units 20. The refrigerant circuit 80 includes a plurality of utilization units 20, a valve unit 40A, and a heat source unit which is not shown and connected to the valve unit 40A.

Each of the utilization units 20 includes a first shutoff valve 51. The first shutoff valve 51 not only shuts off the refrigerant circuit 80 upon detection of a refrigerant leakage, but serves also in decompressing the refrigerant.

The valve unit 40A includes the casing 41, the controller 45, the refrigerant leakage detector 46, the refrigerant pressure acquiring part 47, and a switching mechanism 49. The controller 45 further communicates with the controller 19 of the heat source unit 10 and the controller 25 of each utilization unit 20 via a communication line which is not shown. The switching mechanism 49 is configured to switch the connection of the pipes between the heat source unit and each of the utilization units 20. The operation of the switching mechanism 49 allows the utilization units 20 to perform the cooling operation or the heating operation independently of one another.

The second shutoff valves 52 respectively corresponding to the utilization units 20 are provided in the casing 41 of the valve unit 40A. When the refrigerant leakage detector 26 of one of the utilization units 20 detects a refrigerant leakage, the first shutoff valve 51 and the second shutoff valve 52 corresponding to that utilization unit 20 perform operations such as shutting off the refrigerant and releasing the pressure similar to those in the first embodiment. On the other hand, when the refrigerant leakage detector 46 of the valve unit 40A detects a refrigerant leakage, all the first shutoff valves 51 and the second shutoff valves 52 may perform operations similar to those in the first embodiment.

(2) Characteristic

The second shutoff valves 52 are provided at the valve unit 40A. Accordingly, for example, by the valve unit 40A being disposed in any usually vacant space such as an attic, the space is efficiently used.

(3) Variation

The variations of the first embodiment may be applied to the refrigeration apparatus 90A according to the second embodiment.

REFERENCE SIGNS LIST

20: utilization unit
21: casing
22: heat exchanger
23: fan
25: controller
26: refrigerant leakage detector
27: refrigerant pressure acquiring part
27*a*: temperature acquiring part
27*b*: converting part
29*a* to 29*d*: pipe
30: connection pipe
31: liquid connection pipe
32: gas connection pipe
40, 40A: valve unit
41: casing
45: controller
46: refrigerant leakage detector
50: circuit shutoff mechanism
51: first shutoff valve
52: second shutoff valve
53: refrigerant releasing part
71: first refrigerant pipe
72: second refrigerant pipe
80: refrigerant circuit
90, 90A: refrigeration apparatus

CITATION LIST

Patent Literature

Patent Literature 1: Japanese Patent No. 5517789

The invention claimed is:

1. A refrigeration apparatus comprising:

a heat source unit that includes a compressor and a heat-source heat exchanger, the heat source unit configured to function as a cold source or a hot source;

a utilization unit that includes:

a heat exchanger;

a first refrigerant pipe and a second refrigerant pipe connected to the heat exchanger; and a first shutoff valve and a second shutoff valve whose opening degrees are adjustable, the first shutoff valve and the second shutoff valve being respectively provided at the first refrigerant pipe and the second refrigerant pipe;

a refrigerant circuit including the heat source unit, the utilization unit, and a connection pipe;

a refrigerant leakage detector configured to detect a leakage of the refrigerant from the refrigerant circuit; and a controller configured to close, upon detection of a refrigerant leakage, the first shutoff valve and the second shutoff valve;

determine if a pressure error exists by comparing an acquired pressure against a predetermined threshold pressure value;

adjust, upon determination of a pressure error, the opening degrees of the first shutoff valve and the second shutoff valve such that in an alert state where the first shutoff valve and the second shutoff valve are both closed and a refrigerant leakage has been detected the opening degree of at least one of the first shutoff valve and the second shutoff valve is increased.

2. The refrigeration apparatus according to claim 1, wherein, in the alert state, the controller increases, as the pressure of the refrigerant increases, the opening degree of at least one of the first shutoff valve and the second shutoff valve.

3. The refrigeration apparatus according to claim 1, wherein the refrigerant pressure is acquired by converting any one or more of a temperature of the refrigerant, a temperature of a room where the utilization unit is installed, and a temperature in the utilization unit, into the pressure.

4. The refrigeration apparatus according to claim 2, wherein the refrigerant pressure is acquired by converting any one or more of a temperature of the refrigerant, a temperature of a room where the utilization unit is installed, and a temperature in the utilization unit into the pressure.

5. A refrigeration apparatus comprising:

a heat source unit that includes a compressor and a heat-source heat exchanger, the heat source unit configured to function as a cold source or a hot source;

a utilization unit that includes:

a heat exchanger, and a first refrigerant pipe and a second refrigerant pipe connected to the heat exchanger;

a first shutoff valve and a second shutoff valve whose opening degrees are adjustable, the first shutoff valve and the second shutoff valve being respectively provided at the first refrigerant pipe and the second refrigerant pipe;

a refrigerant circuit including the heat source unit, the utilization unit, and a connection pipe;

a refrigerant leakage detector configured to detect a leakage of the refrigerant from the refrigerant circuit; and a controller configured to close, upon detection of a refrigerant leakage, the first shutoff valve and the second shutoff valve;

determine if a pressure error exists by comparing an acquired pressure against a predetermined threshold pressure value;

adjust, upon determination of a pressure error, the opening degrees of the first shutoff valve and the second shutoff valve such that in an alert state, where the first shutoff valve and the second shutoff valve are both closed and a refrigerant leakage has been detected, the opening degree of at least one of the first shutoff valve and the second shutoff valve is increased, wherein the utilization unit further includes a casing housing the heat exchanger, and at least one of the first shutoff valve and the second shutoff valve is provided outside the casing.

6. The refrigeration apparatus according to claim 5, further comprising a valve unit, wherein at least one of the first shutoff valve and the second shutoff valve is provided at the valve unit.

7. The refrigeration apparatus according to claim 5, wherein the refrigerant pressure is acquired by converting any one or more of a temperature of the refrigerant, a temperature of a room where the utilization unit is installed, and a temperature in the utilization unit into the pressure.

8. The refrigeration apparatus according to claim 6, wherein the refrigerant pressure is acquired by converting any one or more of a temperature of the refrigerant, a temperature of a room where the utilization unit is installed, and a temperature in the utilization unit into the pressure.

9. The refrigeration apparatus according to claim 5, wherein, in the alert state, the controller increases, as the pressure of the refrigerant increases, the opening degree of at least one of the first shutoff valve and the second shutoff valve.

10. A method of reducing a pressure of a refrigerant in a refrigerant circuit including a heat source unit, a utilization unit, and a connection pipe, the utilization unit including a heat exchanger; a first refrigerant pipe and a second refrigerant pipe connected to the heat exchanger; and a first shutoff valve and a second shutoff valve whose opening degrees are adjustable, the first shutoff valve and the second shutoff valve being respectively provided at the first refrigerant pipe and the second refrigerant pipe, the method comprising:

detecting, by a refrigerant leakage detector, a leakage of the refrigerant;

closing, by a controller, the first shutoff valve and the second shutoff valve in response to detection of the leakage;

acquiring a pressure of the refrigerant;

determining if a pressure error exists by comparing the acquired pressure against a predetermined threshold pressure value; and adjusting, upon determination of a pressure error, the opening degrees of the first shutoff valve and the second shutoff valve such that in an alerts state where the first shutoff valve and the second shutoff valve are both closed and a refrigerant leakage has been detected the opening degree of at least one of the first shutoff valve and the second shutoff valve is increased.

* * * * *